US005988228A

United States Patent [19]

Krumm

[11] Patent Number: 5,988,228

[45] Date of Patent: Nov. 23, 1999

[54] LENO SELVAGE FORMER FOR A WEAVING LOOM

[75] Inventor: Valentin Krumm, Hergensweiler, Germany

[73] Assignee: Lindauer Dornier Gesellschaft mbH, Lindau, Germany

[21] Appl. No.: 08/985,854

[22] Filed: Dec. 5, 1997

[30] Foreign Application Priority Data

Dec. 12, 1996 [DE] Germany ..... 196 51 610

[51] Int. Cl.[6] ..... D03C 7/04

[52] U.S. Cl. ..... 139/54

[58] Field of Search ..... 139/54

[56] References Cited

U.S. PATENT DOCUMENTS

| | | | |
|---|---|---|---|
| 2,399,880 | 5/1946 | Moessinger . | |
| 3,613,741 | 10/1971 | Ravella . | |
| 3,698,441 | 10/1972 | Van Mullekom | 139/54 |
| 3,841,358 | 10/1974 | Svaty et al. | 139/54 |
| 3,945,406 | 3/1976 | Wueger | 139/54 |
| 4,103,716 | 8/1978 | Cornellier . | |
| 4,108,213 | 8/1978 | Guttinger | 139/54 |
| 4,421,141 | 12/1983 | Brouwer | 139/54 |
| 4,580,605 | 4/1986 | Gosciniak et al. | 139/54 |
| 5,518,039 | 5/1996 | Haeussler et al. . | |

FOREIGN PATENT DOCUMENTS

| | | |
|---|---|---|
| 0020796A1 | 1/1981 | European Pat. Off. . |
| 2811275 | 9/1978 | Germany . |
| 2538135C2 | 7/1986 | Germany . |
| 19548955C1 | 9/1996 | Germany . |

*Primary Examiner*—Andy Falik
*Attorney, Agent, or Firm*—W. F. Fasse; W. G. Fasse

[57] ABSTRACT

A leno thread tensioner (26, 26A, 26B) is positioned upstream, as viewed in the movement direction of the leno threads (9, 10), of a leno selvage former (1) for tensioning the leno threads especially during change-over of the leno thread. Additionally, or instead, a leno thread spreader (23) and detour member is positioned downstream of the leno selvage former for preventing intertwining of the leno threads before they are bound into the leno selvage.

18 Claims, 4 Drawing Sheets

LENO SELVAGE FORMER FOR A WEAVING LOOM

FIELD OF THE INVENTION

The invention relates to a leno selvage forming apparatus for a weaving loom in which the leno threads are properly guided and preferably also tensioned to assure a positive formation of the leno shed.

BACKGROUND INFORMATION

Leno selvage forming devices are known in the art for example from German Patent Publication DE 25 38 135 C2 (Wueger), published on Mar. 11, 1976 and based on U.S. Ser. No. 500,792, filed Aug. 26, 1974. Further, reference is made to German Patent Publication DE 28 11 275 A1 (Cornellier), published on Sep. 21, 1978 and based on Canadian Patent Application No. 273,993, filed on Mar. 15, 1977. Each of these known devices comprises two coils or spools for supplying leno threads. The leno threads are pulled off these leno coils for the selvage formation along the edge of the fabric. The leno forming components are driven in synchronism with the loom drive or are preferably combined with the loom drive, however concrete features as to the drive and control are not disclosed in these two publications. In German Patent Publication 25 38 135 C2 tension springs (54) take up slack in the leno threads between the respective thread guides (47, 51) and eyelets (48) and (52) leading the leno threads into the leno forming device. Thus, the tensioning is effective downstream of the thread guides (47, 51) as viewed in the feed advance direction of the leno threads. In German Patent Publication 28 11 275 A1 the leno thread eyelets are positioned at the end of spring tensioned arms (44) and (46). The spring tension is applied to these eyelet carrying arms by a spring (92) the bias of which is adjustable.

European Patent Publication EP 00 20 796 A1 (Koch et al.), published on Jan. 7, 1981 discloses a leno thread supply mechanism for a loom in which tension is applied to the leno threads substantially in the same manner as in German Patent Publication 28 11 275 A1 in that the eyelet carrying arms for guiding the leno threads are spring-biased by a helical spring (55), the tension of which is adjustable. The drive for the leno forming device is not shown in any detail.

U.S. Pat. No. 2,399,880 (Moessinger), issued on May 7, 1946 discloses a leno selvage device including a rotatable leno disk, the drive for which is derived from the central loom drive. Details regarding the tensioning of the leno threads are not disclosed except that the supply coils for the leno threads are provided with a brake mechanism for maintaining the leno thread tension between the leno supply spool and the leno disk.

The above described conventional devices for forming a selvage do not comprise any leno thread guide elements that are reversible in their rotation. The difficulties of maintaining the proper thread tension in the leno threads when the leno disk reverses its rotational direction, are thus not addressed in the above discussed references.

German Patent Publication DE 195 48 955 C1 describes a leno selvage forming device in which the rotational axis of the rotor extends in parallel to the warp threads. The device is arranged outside the space occupied by the heald frame or heald shafts. Due to this position of the selvage forming devices the resulting selvage is positioned with a spacing between the selvage proper and the outermost warp thread. Such a selvage former is rather involved and hence economically not feasible. Another embodiment in the German Patent Publication DE 195 48 955 C1 discloses the positioning of the leno selvage former with is rotational axis at an angle of preferably 45° to the direction of the warp threads. Such positioning requires a detour roller for the leno threads, but has the advantage that the selvage is formed directly next to the outermost warp thread in the fabric. It is not quite clear, however, whether the detour roller is mounted for rotation or whether it is rigidly mounted, nor whether the detour roller is driven. It is not disclosed how any accumulation of twisted leno threads upstream of the detour roller is avoided, nor are the problems of properly forming the leno shed and how to avoid leno thread breakage addressed. The above mentioned detour roller contributes to the twisting of the leno threads.

Tests were made by the applicants with leno selvage formers having a rotating thread guide element including a detouring guide for the leno threads. These tests have shown that a fixed detour guide does not result in properly forming a leno thread shed in synchronism with the formation of the loom shed, nor with the weft thread insertion. This is particularly true when leno threads are used having a quality standard Nm200/1 which are substantially not stretchable, and have a substantial tearing strength. As a result, the weft thread ends are not properly bound into the selvage or not bound into the selvage at all.

This due to the twisting or intertwining of the selvage threads at the fixed detour guide. If the detour guide itself is cylindrical and mounted for rotation it is not possible to fully exclude an unintended rotation in the reverse direction of the roller. Such reverse direction rotation may be caused, for example by loom vibrations. In such a case the proper formation of the leno shed is prevented so that the insertion of the weft thread into the leno shed is also disturbed.

German Patent Publication 195 48 955 C1 discloses a leno former with a hollow shaft arranged at a right angle to the direction of the warp threads. Two guide elements spaced from each other are mounted on the hollow shaft. Here again a tension compensation for the leno threads is not provided for as the threads travel from the supply spools to the fabric although tension variations occur with each detour of the leno threads. Thus, again a proper formation of the leno shed is not assured. As a result, the weft insertion can collide with the leno threads, which at the time of arrival of the weft thread are not properly tensioned. These difficulties occur alike for the conventional arrangement of the rotational axis of the leno former at 90° and at 45° to the direction of the warp threads unless attention is paid to the proper tensioning of the leno threads.

OBJECTS OF THE INVENTION

In view of the foregoing it is the aim of the invention to achieve the following objects singly or in combination:

- to make sure that the required detouring of the leno threads on their way between the leno selvage former and the selvage into which the weft thread ends are to be tied up, will not disturb the leno shed formation;
- to keep the leno threads at all times on their way from the supply spools to the selvage at the required thread tension especially also during the change of the leno shed in order to make sure that the leno shed is correctly formed at all times in synchronism with the loom shed formation;
- to avoid jamming or intertwining of the leno threads at the detour guides;
- to minimize or at least substantially reduce breakage of leno threads, especially breakage due to intertwining of the leno threads; and to properly bind each weft thread into the leno selvage directly next to the respective warp thread.

SUMMARY OF THE INVENTION

The above objects have been achieved according to the invention by providing for both leno threads a detour causing roller body of rotational symmetry onto which the leno threads travel as they exit from the respective guide eyelet of the leno former, wherein the body of rotational symmetry is rotatably mounted for rotation in at least one direction about its geometric longitudinal axis. The detour body functions as a leno thread spreader. The rotatability of the detour body leno thread spreader may be caused by the leno threads or the detour body may be positively driven by a respective drive motor. In case the detour body is driven by the leno threads themselves, it is preferred that a friction enhancing contact between the surface of the detour body and the leno thread is provided. Further, if the detour body of rotational symmetry is not positively driven, but free-wheeling in response to leno threads running over the detour body it is preferred that the body is equipped with a reverse stop so that it can rotate only in the feed advance direction of the leno threads and not in opposition thereto. It has been found that rotation of the detour body in a direction opposite to the feed advance direction of the leno threads actually enhances the tendency of the leno threads to be twisted and intertwined so that limiting the rotation direction of the rotational body in the feed advance direction of the leno threads is preferred.

If the detour body or spreader is positively driven, for example by an electric or hydraulic motor, such drive is controlled by the central machine control in synchronism with the loom shed formation, to advantageously avoid twisting of the leno threads at the detour body. The synchronization of the leno thread shed formation with the warp thread shed formation is important to make sure that the weft thread ends can be correctly inserted into the leno shed and bound into the leno selvage by the leno threads. The synchronization is important regardless whether the detour body is driven by an electric motor or by a pneumatic drive.

The detour body preferably has a surface configuration that keeps the leno threads spread apart as they travel over the surface of the detour body. Thus, the detour body preferably has a polygonal cross-sectional configuration which in combination with a friction enhancing surface provides a proper guiding or detouring of the leno threads so that they will not intertwine. The surface may, for example, be rubberized or provided with any other suitable friction enhancing coating. However, a smooth surface on a detour body having a polygonal cross-sectional configuration has an advantageous influence on the detouring of the leno threads.

According to the invention a tensioning device for the leno threads is positioned upstream of the leno selvage former between the latter and the leno thread supply spools. It has been found that such a position for the tensioning device is most efficient in applying the proper tension to the leno threads at all times and particularly during the direction reversal of the rotation of the leno former. The tensioning device may operate pneumatically or mechanically. The tensioning force is so controlled that the applied tension is varied in accordance with the tension requirements and in such a way that particularly during the change of the leno shed the proper applied tension assures the correct formation of the next leno shed. The use of a tensioning device positioned upstream and outside of the leno former is advantageous regardless whether the rotational axis of the leno former extends at a right angle or a slanted angle to the warp threads.

A pneumatically effective leno thread tensioning device comprises at least one leno thread guide channel preferably having a cylindrical cross-section and positioned between the leno thread supply spools and the leno selvage former. The thread guide is positioned in the plane of the leno threads coming from the supply spools. An injector nozzle blows its air into the channel in a direction substantially opposite to the withdrawal or movement direction of the leno threads. The ejection of tensioning air blows is preferably so controlled that it is clocked by the change of the leno thread shed. For this purpose preferably, but not necessarily, a pneumatic control is provided for the ejection nozzle. The pneumatic control includes a controllable valve which is connected to the central loom control. A control program for the ejection of the tensioning jets is stored in the central control and the control program in turn is synchronized with the shed formation. The pneumatic medium such as air is supplied from a pressurized air source that is normally part of the loom and the controllable valve provides the respective spurts of compressed fluid to the injection nozzle.

Instead of a pneumatically effective tensioning device the invention also includes mechanically effective tensioning devices positioned upstream of the leno former, but downstream of the supply spools. The mechanical leno thread tensioning device may be controlled or permanently spring-biased, whereby a spiral spring or a spring lever may be used. It is important for all types of leno thread tensioning devices that they are positioned upstream of the leno former to effectively prevent any intertwining of the two leno threads coming from the supply coils.

BRIEF DESCRIPTION OF THE DRAWINGS

In order that the invention may be clearly understood, it will now be described, in connection with an example embodiment of the invention with reference to the drawings, wherein.

DETAILED DESCRIPTION OF PREFERRED EXAMPLE EMBODIMENTS AND OF THE BEST MODE OF THE INVENTION

Figure 1:
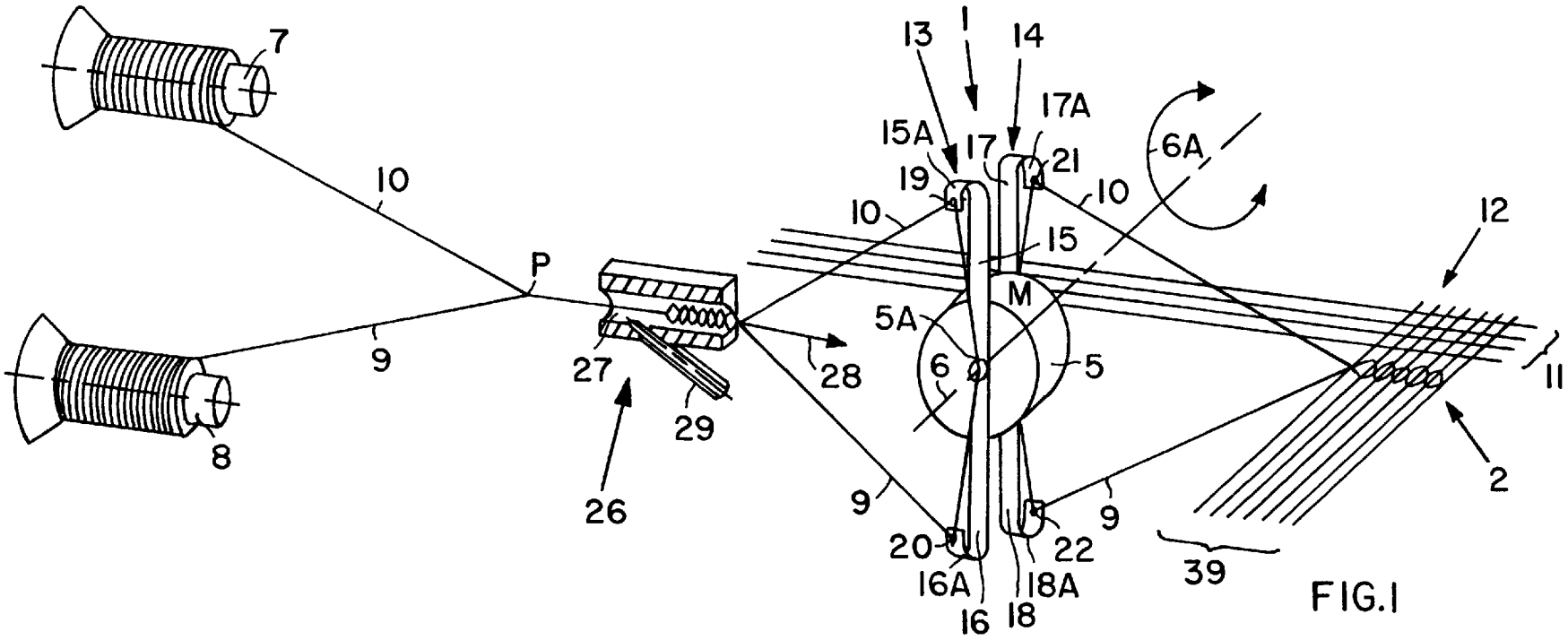
FIG. 1 is a perspective view of a leno selvage forming device equipped according to the invention with a pneumatic tensioning device positioned upstream of a leno former (1) as viewed in the movement direction of the leno thread, whereby the leno former (1) is oriented with its rotational axis perpendicularly to the warp threads.

The perspective view of FIG. 1 shows a leno forming device including the leno selvage former 1, upstream a leno thread tensioning device 26 positioned upstream of the selvage former 1 and leno supply spools 7 and 8 positioned upstream of the tensioning device 26 as viewed in the leno thread travel direction. The leno selvage former 1 comprises a drive motor 5 having a hollow shaft 5A with a rotational axis 6. The motor 5 is reversible as indicated by the double arrow 6A. In the embodiment of FIG. 1 the rotational axis 6 is positioned in the plane formed by the warp threads 11 and approximately perpendicularly to the warp threads 11. Leno threads 9 and 10 pass through the tensioning device 26 to be described in more detail below and travel through the hollow shaft 5A from a first leno thread guide 13 to a second leno thread guide 14. These guides 13 and 14 are secured to opposite ends of the motor shaft 5A for rotation with the motor shaft 5A. The warp threads 11 together with the weft thread 39 form the fabric 12 and the leno threads 9 and 10 are formed into a leno selvage 2. The leno thread guides 13 and 14 have a mirror-symmetrical construction relative to each other. The guide 13 comprises an arm 15 with a bent over end 15A and an arm 16 with a bent over end 16A. Each bent over end 15A, 16A is provided with an eyelet 19 and 20 respectively for the leno threads. The guide 14 comprises two arms 17 and 18 each provided with a respective bent over end 17A and 18A also provided with a respective eyelet 21 and 22. The two leno thread guides 13 and 14 with their respective arms extend in parallel to one another at opposite ends of the drive shaft 5A of the motor 5, the rotor of which drives the guides 13 and 14 back and forth as indicated by the arrow 6A. The leno threads 9 and 10 run through the eyelets 19 and 20 as well as 21 and 22 after passing through the tensioning device 26 from the supply spools 7 and 8. When the rotor of the motor 5 rotates, the leno thread guides 13 and 14 assure with their back and forth rotary motions the formation of the full leno selvage 2 along the edge of the fabric 12.

The leno threads 9, 10 are exposed to twisting and intertwining on their way from the leno supply spools 7, 8 to the selvage as indicated at point P in FIG. 1 just upstream of the tensioning device 26 as viewed in the travel direction of the threads 9, 10 from the spools 7, 8 to the selvage 2. This intertwining is then removed again by the rotation of the guides 13, 14 following a defined number of revolutions in one direction by a sufficient number of revolutions in the opposite direction. The intertwining of the leno threads in the selvage itself is not affected by the removal of the intertwining upstream of the selvage because the weft threads 39 hold the intertwined leno threads securely in the selvage 2. As a result, the formation of the leno selvage is continued by the intertwining of the leno threads with the weft threads in the selvage even though the intertwining upstream of the selvage is removed.

Figure 2:
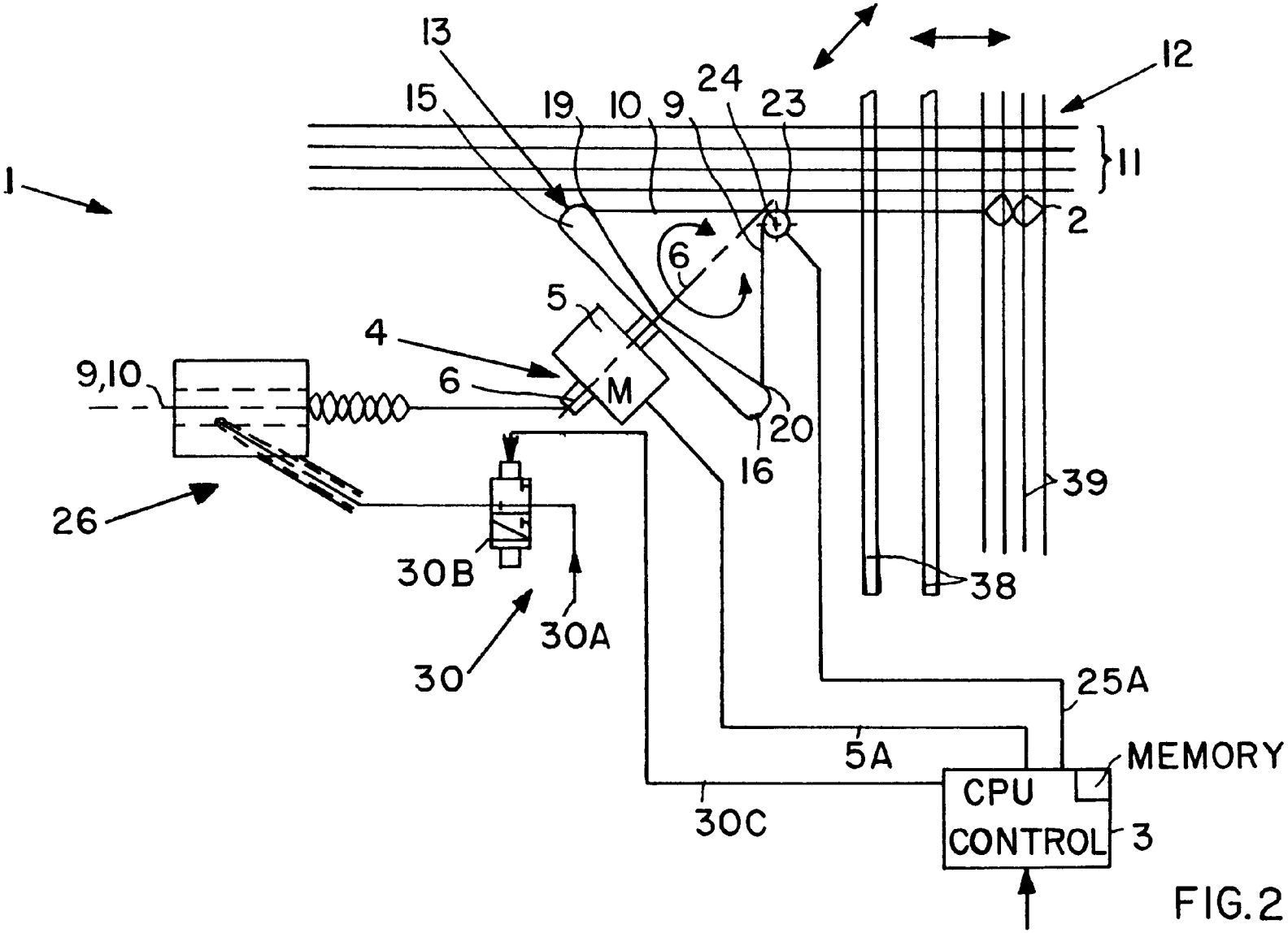
FIG. 2 is a perspective view similar to that of FIG. 1, however illustrating the position of the leno former (1) with its rotational axis oriented at approximately 45° to the direction of the warp threads and including, in additional to the tensioning device, a rotatable leno thread spreader.

In operation the motor 5 with its hollow shaft 5A is driven in synchronism, preferably from the main loom drive, with the held frame or shaft 38 shown in FIG. 2, so that the formation of the loom shed and the formation of the leno shed take place in synchronism with each other for the opening and change over of the respective sheds to form a full leno selvage. However, it is also possible to provide a certain phase shift between the opening of the loom shed and the opening of the leno shed which involves a certain delay between the rotational motion of the guides 13 and 14 on the one hand and the motion of the held frame on the other hand followed by a corresponding shift or delay in the beat-up of the weft threads. Stated differently, a leno former is independent of the motion of the held frame as compared to conventional leno forming devices which are arranged within the held frames and move with the latter.

FIG. 2 shows a leno former 1 similar to that of FIG. 1, except that in FIG. 2 the rotational axis 6 of the motor 5 extends at an angle of 45° to the warp threads 11, making it necessary to provide a leno thread detouring and spreader 23 which, according to the invention, is a body of rotational symmetry rotatable about a rotational axis 24. This spreader 23 is positioned downstream of the guide 13. Only one guide 13 is provided in the embodiment of FIG. 2 rather than two such guides 13 and 14 shown in FIG. 1.

Figure 3:
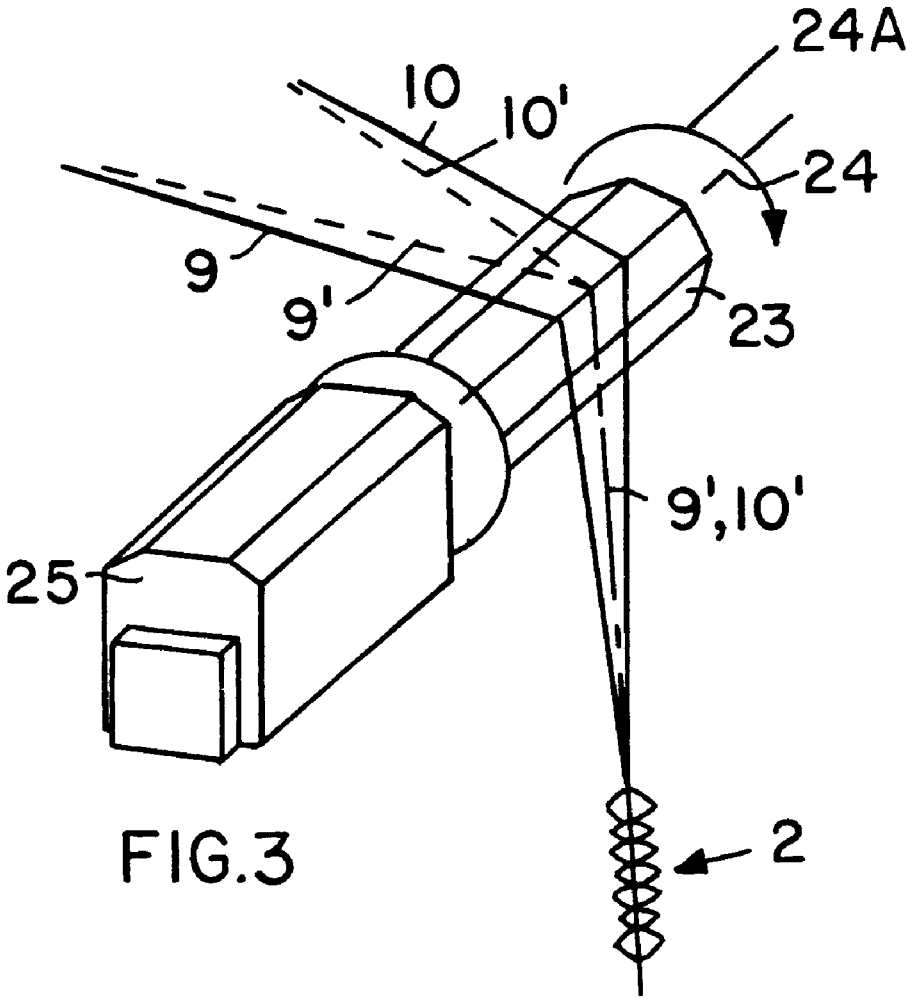
FIG. 3 illustrates a perspective view of the present weft spreader in the form of a rotatable body of rotational symmetry positively driven by a motor.
Figure 4:
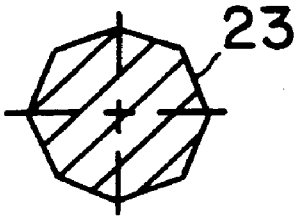
FIG. 4 shows a sectional view through the leno thread spreader.

FIG. 3 shows the spreader 23 on a somewhat enlarged scale compared to FIG. 2. According to the invention the spreader 23 is driven by a motor 25 such as a controllable electrical motor, preferably in the form of a stepping motor. However, the motor 25 may also be a pneumatic drive or the like. The spreader 23 has a polygonal cross-sectional configuration as best seen in FIG. 4. According to the invention the conventional twisting of the leno threads 9 and 10 downstream of the guide 13 is prevented by a resistance imposed by the spreader 23 on the leno threads travelling over the surface of the spreader 23. Such resistance may, for instance be achieved by providing a friction enhancing surface on the spreader 23 or by providing the spreader with a polygonal cross-section as mentioned above. FIG. 3 shows by dashed lines 9' and 10' the undesirable premature conventional intertwining of the leno threads. Contrary thereto according to the invention the leno threads 9 and 10 only start intertwining where the leno selvage 2 is being formed downstream of the spreader 23.

Due to the cross-sectional configuration of the spreader 23 and/or due to the respective friction enhancing surface formation of the rotatably mounted preferably positively driven spreader 23 the proper formation of the leno shed by the leno selvage former 1 according to FIG. 2 is assured.

In the embodiment of FIGS. 1 and 2 the invention positions the above mentioned leno thread tensioning device 26 upstream of the guides 13 and 14. This tensioning device 26 is so constructed that it applies a counter-force or tension to the leno threads, particularly during the change of the leno shed. This counter tension is effective in a direction opposite to the force component 28 indicating the pulling of the leno threads off the spools 7 and 8. This counter force or tension makes sure that the leno threads are properly tensioned during the leno shed change-over to assure a correct leno shed formation, whereby faulty weft insertions, faulty weft bindings, and breaks in the leno threads as well as in the weft threads are avoided. These advantages of the tensioning device 26 lead to a reduction of dead time thereby increasing the productivity of the loom.

The tensioning device 26 shown in FIGS. 1 and 2 comprises a pneumatic ejector nozzle 29 blowing into a channel 27, preferably a cylindrical channel 27 through which the leno threads 9 and 10 must travel before reaching the guide 13. The longitudinal axis of the channel 27 is preferably oriented in the direction of the leno selvage formation, namely approximately in parallel to the warp threads in FIGS. 1 and 2, whereby further detours of the leno threads are avoided as the leno threads are pulled off the spools 7 and 8 while travelling to the leno selvage formation along the edge of the fabric 12 as indicated by the selvage 2.

The ejector nozzle 29 is directed so that its blast applies a tension component opposite the pull off component or force 28. As shown in FIG. 2 the nozzle 29 is connected to a source of pneumatic pressure through a pressurized line or conduit 30A including a valve 30B forming a flow control 30. The flow control 30, or rather the controllable valve 30B thereof is connected through a control electrical conduit 30C to the central processing unit 3 forming part of the central control of the loom. The valve 30B is preferably an electromagnetically adjustable valve. The CPU 3 includes a memory in which the control program for the valve 30B is stored for operation in synchronism with the shed formation in the loom.

The motor 5 is also connected through an electrical conductor 5A with the CPU 3, whereby it is assured that the leno threads 9 and 10 are tensioned by the blast from the nozzle 29 in synchronism with the change of the leno shed to produce a respective tension on the leno threads opposite to the pulling tension produced by the motor 5.

Figure 5:
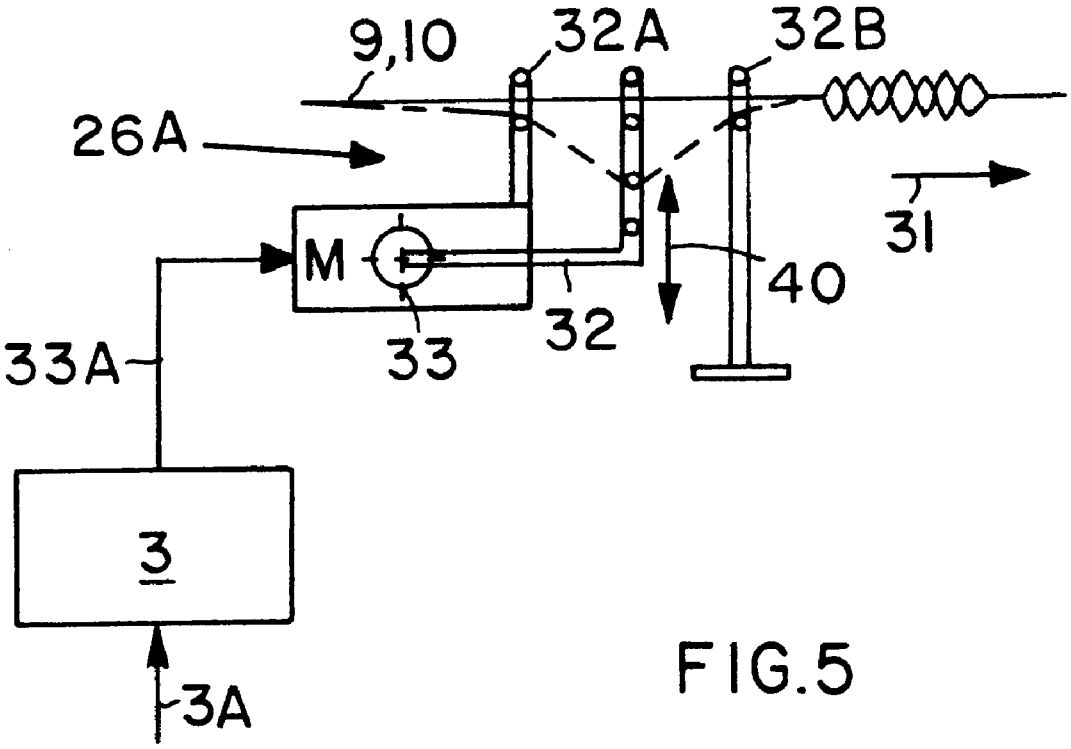
FIG. 5 shows a motor controlled mechanical tensioning device that may take the place of the pneumatic tensioning device (26) upstream of the leno former (1) as viewed in the travel direction of the leno threads in FIGS. 1 and 2.
Figure 6:
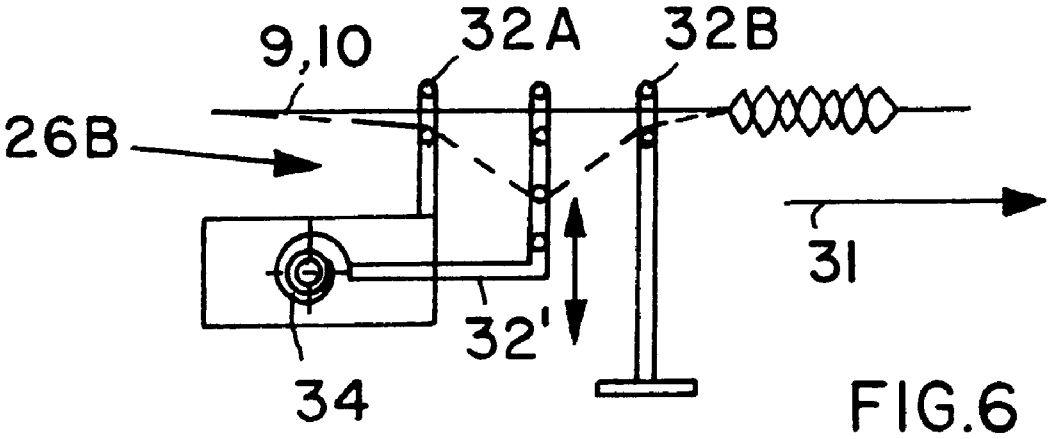
FIG. 6 is a view similar to that of FIG. 5, but illustrating a spiral spring that applies a permanent spring bias to the leno threads upstream of the leno former (1).

FIGS. 5 and 6 illustrate mechanical tensioning devices for the leno thread that may be used instead of the pneumatic device 26 upstream of the leno selvage former 1. FIG. 5 shows a leno thread tensioning device 26A with a leno deflector arm 32 driven by a motor 33 to deflect the leno threads in a direction 40 substantially perpendicularly to the feed advance direction 31. Preferably, two guide eyelets 32A and 32B are positioned on either side of the motor driven deflector arm 32 for properly presenting the respective leno thread to the deflector arm 32. The motor 33 receives its control signal through an electrical control conductor 33A connected to the central control 3. The respective control program is entered into the CPU 3 by a keyboard shown symbolically by an arrow 3A. The deflection of the leno threads 9 and 10 will take place in synchronism with the leno thread change to make sure that the following leno shed formation takes place in proper time sequence with the operation of the loom shed and in a geometrically correct manner, whereby the insertion of the weft thread into the leno shed is assured.

FIG. 6 shows a leno thread tensioning device 26B similar to that of FIG. 5, however the deflector 32' is biased by a spring, preferably a spiral spring 34 rather than motor driven. The spring 34 applies a constant biasing to the leno threads as opposed to a timed biasing as described above with reference to FIG. 5 for the tensioning device 26A. The tensioning device 26B of FIG. 6 is not controlled at all and thus applies a permanent constant bias to the leno threads 7 and 8. The guide eyelets 32A and 32B function in FIG. 6 in the same way as in FIG. 5.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A device for forming a leno selvage (2) in a fabric on a weaving loom, said device comprising leno thread supply spools for feeding leno threads, a leno selvage former (1) positioned between said supply spools (7, 8) and said leno selvage (2), said leno selvage former (1) comprising first drive motor (5) having a rotational axis extending at an angle to warp and weft threads, a leno thread detouring member (23) positioned between said leno selvage former (1) and said leno selvage (2), said leno thread detouring member comprising a leno thread spreader roller (23) mounted for rotation in at least one rotational direction for detouring said leno threads, said leno thread spreader roller (23) having a profiled surface for spreading said leno threads apart from each other to prevent intertwining of said leno threads between said leno selvage former (1) and said leno selvage (2), and a second drive motor (25) connected to said leno thread spreader roller for positively driving said leno thread spreader roller in said at least one direction.

2. The device of claim 1, further comprising a control unit (3) and control conductors connecting said first drive motor (5) and said second drive motor (25) to said control unit (3) for operating said first and second drive motors (5, 25) in synchronism with each other.

3. The device of claim 2, wherein said second drive motor (25) is a stepping motor.

4. The drive of claim 2, wherein said second drive motor (25) is a pneumatic drive motor.

5. The device of claim 1, wherein said profiled surface of said leno thread spreader roller is a friction enhancing surface for entraining portions of said leno threads travelling into contact with and on said friction enhancing surface.

6. The device of claim 5, wherein said friction enhancing surface comprises a rubberized coating on said leno thread spreader roller.

7. The device of claim 1, wherein said profiled surface has rotational symmetry.

8. The device of claim 1, wherein said profiled surface is a polygonal surface.

9. The device of claim 1, further comprising a leno thread tensioner (26) positioned between said supply spools (7, 8) and said leno selvage former (1).

10. The device of claim 1 wherein said angle between said rotational axis (6) of said first drive motor (5) and said warp threads is 45°.

11. A device for forming a leno selvage (2) in a fabric on a weaving loom, said device comprising leno thread supply spools (7, 8) for feeding leno threads, a leno selvage former (1) positioned between said supply spools and said leno selvage (2), said leno selvage former (1) comprising a drive motor (5) having a rotational axis (6), and a leno thread tensioner (26, 26A, 26B) between said supply spools (7, 8) and said selvage former (1), wherein said leno thread tensioner is positioned upstream of said leno selvage former (1) as viewed in the feed advance direction of said leno threads, and wherein said leno thread tensioner comprises a housing, a fluid flow channel (27) through said housing and an infector nozzle (29) leading into said flow channel (27) for blowing a fluid into said flow channel, said fluid having a force component effective on said leno threads in a direction opposite to said feed advance direction (28) of said leno threads (9, 10).

12. The device of claim 11, wherein said injector nozzle (29) of said leno thread tensioner (26) is a pneumatic injector nozzle.

13. The device of claim 12, further comprising a source (30A) of pressurized gas, a pressure line connecting said source (30A) to said pneumatic injector nozzle, and a controllable valve (30B) in said pressure line for controlling fluid flow through said pneumatic injector nozzle.

14. The device of claim 11, further comprising a leno thread spreader roller (23) positioned downstream of said leno selvage former (1) as viewed in the feed advance direction of said leno threads.

15. A device for forming a leno selvage (2) in a fabric on a weaving loom, said device comprising leno thread supply spools (7, 8) for feeding leno threads, a leno selvage former (1) positioned between said supply spools and said leno selvage (2), said leno selvage former (1) comprising a drive motor (5) having a rotational axis (6), and a leno thread tensioner between said supply spools (7, 8) and said selvage former (1), wherein said leno thread tensioner is positioned upstream of said leno selvage former (1) as viewed in the feed advance direction of said leno threads, wherein said leno thread tensioner is a mechanical thread tensioner comprising at least one leno thread deflector (32, 32') for deflecting said leno threads (9, 10) and a drive connected to said at least one leno thread deflector (32) for displacing said at least one leno thread deflector (32).

16. The device of claim 15, wherein said drive for said at least one leno thread deflector (32) is an electric motor (33), said device further comprising a control unit (3) connected to said electric motor (33) for controlling through said electric motor deflections of said leno thread deflector (32).

17. The device of claim 15, wherein said drive for said at least one leno thread deflector (32') comprises a spring drive (34) connected to said leno thread deflector for biasing said leno thread deflector into a deflecting position.

18. The device of claim 15, further comprising two guide eyelets (32A and 32B) one of which is positioned on either side of said mechanical thread tensioner.

* * * * *